United States Patent [19]

North

[11] 4,328,902

[45] May 11, 1982

[54] BEVERAGE CARRIER

[76] Inventor: Thomas M. North, 3455 Whitfield, Waterford, Mich. 48095

[21] Appl. No.: 208,571

[22] Filed: Nov. 20, 1980

[51] Int. Cl.[3] ..... B65D 21/02

[52] U.S. Cl. ..... 220/23.4; 220/21

[58] Field of Search ..... 220/23.4, 21, 346, 347

[56] References Cited

U.S. PATENT DOCUMENTS

| | | | |
|---|---|---|---|
| 2,454,438 | 11/1948 | Falk . | |
| 2,495,132 | 1/1950 | Remco | 220/23.4 |
| 3,131,829 | 5/1964 | Masser . | |
| 3,194,426 | 7/1965 | Brown | 220/23.4 |
| 3,297,196 | 1/1967 | Cornelius . | |
| 3,317,081 | 5/1967 | Cornelius . | |
| 3,343,705 | 9/1967 | Erickson . | |
| 3,404,805 | 10/1950 | Stockmann . | |
| 3,851,936 | 12/1974 | Muller . | |
| 4,192,422 | 3/1980 | Kotyuk | 220/346 |

FOREIGN PATENT DOCUMENTS

| | | | |
|---|---|---|---|
| 456287 | 1/1927 | Fed. Rep. of Germany | 220/23.4 |
| 1175144 | 7/1964 | Fed. Rep. of Germany | 220/23.4 |
| 2232494 | 7/1973 | Fed. Rep. of Germany | 220/346 |

*Primary Examiner*—George E. Lowrance

*Attorney, Agent, or Firm*—Fisher, Gerhardt, Crampton & Groh

[57] ABSTRACT

A beverage carrier assembly including a pair of article supporting end carrier units each having interlocking means for engagement with a center carrier unit. In one form, the three carriers may each be an eight-pack carrier providing a tri-unit assembly for use as a standard 24 bottle or can beverage transporting case. The carriers are readily separable into individual hand carrying units by upward lifting of the center carrier. A dovetail coupling structure interlocks the carriers and may include a releasable detent locking arrangement.

3 Claims, 5 Drawing Figures

BEVERAGE CARRIER

BACKGROUND OF THE INVENTION

This invention relates to article carriers and more particularly to a carrier assembly suitable for being separable into a plurality of units such as 6 or 8-pack beverage carriers.

Various holders for bottles and cans in units of six or more have been proposed such as the interlockable carrier shown in U.S. Pat. No. 3,317,081 issued to Cornelius. The '081 Cornelius patent discloses a bottle-carrier adapted to be coupled with other units to provide a composite carrier assembly. The U.S. Pat. No. 3,131,829 issued to Masser and the U.S. Pat. No. 3,851,936 issued to Muller disclose article-carrying containers which are interlockable by dovetailed means.

The Muller and Masser patents are examples of prior art interlocking carriers which have asymmetrical interlocking arrangements that are both difficult to fabricate and time consuming to assemble. The Cornelius patent requires that the carriers be moved in a defined longitudinal manner to separate the units.

It would be highly desirable and it is an object of this invention to provide carrier units which may be readily interlocked into a multi-carrier assembly.

It is another object of the present invention to provide symmetrical container carrying units which may be readily oriented and interlocked to provide a composite carrying case assembly wherein the user may lift a center carrier for separation from a pair of end carriers.

It is still another object of the present invention to provide a multiple unit carrier assembly as set forth in the above objects wherein the units may be readily interlocked by dovetail interlocking structure together with a releasable detent locking arrangement.

SUMMARY OF THE INVENTION

A carrier assembly is provided wherein at least a pair of identical end carrier units may be interlocked with an intermediate center unit by a dovetail interlocking structure. The intermediate center carrier unit is dropped into interlocking engagement with the pair of spaced end carriers enabling the user by grasping handle means on the end carriers, to transport the carriers as a tri-unit assembly. Each of the end carriers includes vertically extending angle-sided slot means of a dovetail locking structure disposed in symmetrical relation with respect to the transverse medial plane of the carrier. The center intermediate carrier has vertically extending angle sided projection means of the dovetail locking structure disposed symmetrical with the transverse medial plane. Both the slot means and the projection means of the dovetail structure are spaced a predetermined distance from the upper and lower edges of their associated carrier side wall. This arrangement allows the dovetail projection portion of the center carrier to be brought into flush abutment with a side wall of an end carrier. Thus, with the end carriers oriented in predetermined spaced array the center carrier projection means may be readily coupled and uncoupled from the end carriers by lowering and raising the center carrier, respectively.

These and other features and advantages of the present invention will be apparent from the following disclosure and the drawings in which.

DESCRIPTION OF THE PREFERRED EMBODIMENT

Figure 1:
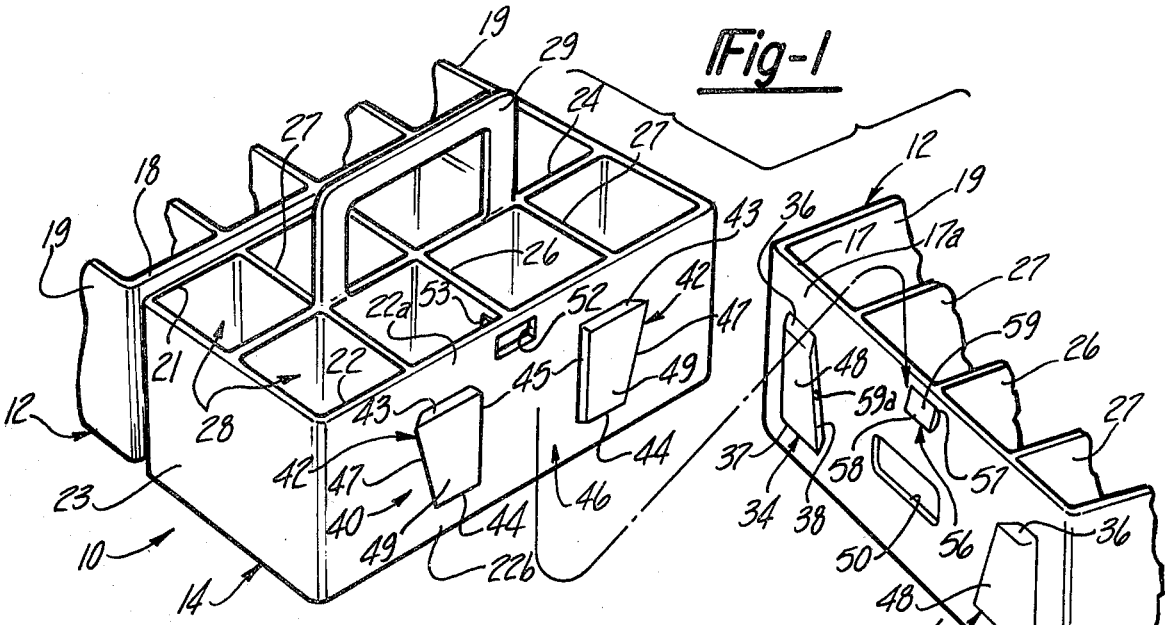
FIG. 1 is a perspective view illustrating a plurality of carriers in separated form constructed in accordance with the present invention.
Figure 2:
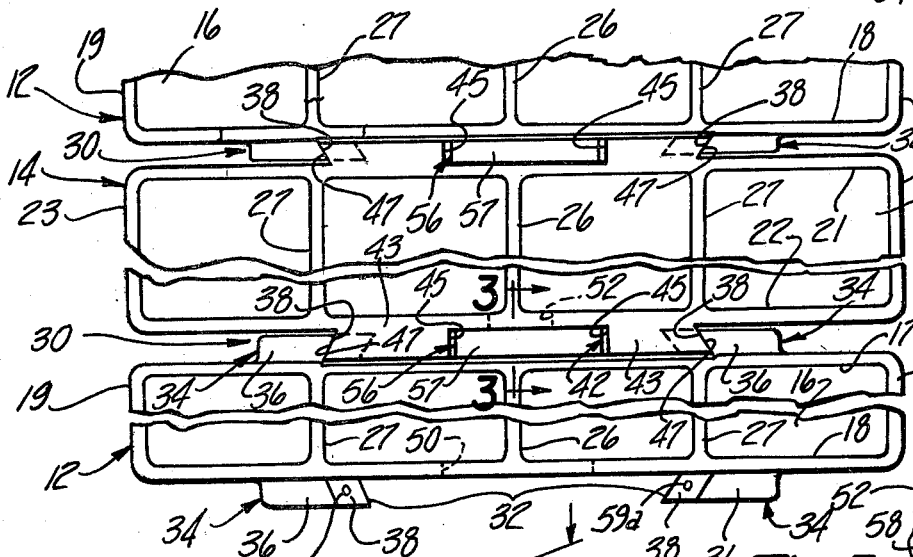
FIG. 2 is a fragmentary horizontal elevational view, partly in section, showing a plurality of carriers interlocked in accordance with the present invention.

In the preferred embodiment of FIGS. 1 and 2 the carrier assembly, generally indicated at 10, consists of a plurality of individual box-shaped carrier units namely, a pair of outer or end carriers 12 and an inner or center carrier 14. Each end carrier 12 comprises a bottom or base wall 16, opposite spaced parallel side walls 17 and 18, and end walls 19. In a similar manner the center carrier comprises a bottom or base wall 20, opposite spaced parallel side walls 21 and 22, and end walls 23.

Each of the carriers 12 and 14 have substantially identical internal divider construction, which dividers in the preferred embodiment are adapted to support a plurality of containers. Thus, only the center carrier 14 internal construction will be described in detail. In the form shown in FIGS. 1 and 2 the carrier 14 has a longitudinal divider 24 extending between the end walls 23 and a plurality of transverse dividers. FIG. 1 shows carrier 14 having a central transverse divider 26 located on the transverse medial vertical plane of the carrier and a pair of end dividers 27. The dividers 26 and 27 extending from the longitudinal divider 24 to each of the side walls 21 and 22, providing two rows of container supporting cells 28.

In the tri-carrier assembly shown in FIGS. 1 and 2, each of the three units serves as an 8-pack carrier. Upon the two end carriers 12 and the center carrier 14 being interlocked into the assembly 10 a twenty-four container case is provided. It is contemplated that the tri-carrier assembly 10 may have overall dimensions comparable to the standard twenty-four bottle wooden cases that are conventionally used with bottling plant machinery.

The longitudinal divider 24 includes handle means which, in the FIG. 1 embodiment, is an inverted U-shaped liftable handle 29 preferably formed integral with the longitudinal divider 24. In the disclosed form the carriers are molded from a suitable plastic material such as impact polystyrene, for example. It will be understood, however, that the applicant's invention could be fabricated from various materials such as paperboard, wood, metal, etc. without departing from the scope of the invention.

As shown, the pair of end carriers 12 are interlocked with the center carrier 14 by means of dovetail interlocking structures indicated by numeral 30 in FIG. 2. The dovetail interlocking structures include vertically extending, downwardly converging slot means 32 provided on each sidewall 17 and 18 of the end pair of carriers 12. As viewed in the right-hand separated carrier 12 of FIG. 1, the slot means 32 is formed by a pair of mirror image, block-like shoulders 34 integral with each sidewall 17 and 18. The shoulders 34 are symmetrical with the carrier transverse medial plane defined by the central transverse divider 26.

Each of the shoulders 34 included upper 36 and lower 37 ends and opposed guide faces 38 downwardly tapered at a draft angle of about 30° from the vertical in the form shown. The guide faces define acute notched angles with respect to the carrier's sidewalls 17 and 18, as shown in FIG. 2.

As best seen in FIGS. 1 and 2, to provide for proper weight distribution and ease of operation, the shoulders 34 must be positioned on each side wall 17 and 18, so that the horizontal distance between the opposed guide faces 38, as measured from the junction of the upper end 36 and the guide face 38, is no less than one-half the length of the side walls 17 and 18.

As best seen in FIG. 1 the center carrier sidewalls 22 and 21 each include projection means in the form of key portion 40 of identical locking structures 30. The key portion 40 in FIGS. 1–3 comprises a pair of block-like, mirror image, half key members 42 integrally formed on each sidewall 21 and 22 aymmetrical to the medial vertical plane of the central divider 26. Each half key 42 includes an upper end 43, a lower end 44 and a pair of inward facing opposed sides 45 defining a vertical channel 46. Each half key member 42 has an outward facing angled spline face 47 downwardly tapered at an angle of about 30° from the vertical. The spline faces 47 define acute dihedral angles with their associated sidewalls 21 and 22. As seen in FIG. 2 the angled shoulder guide faces 38 and spline faces 47, when slidably indexed together in an interlocked dovetailed manner, prevent separation of the carriers in a transverse direction normal to the carrier sidewalls.

Each sidewall of the carriers 12 includes handle means to enable lifting of the assembled carriers. FIGS. 1 and 2 show handle means on the sidewalls 17 and 18 of the end carrier 12 in the form of elongated finger gripping openings 50 provided between the spaced shoulders 34.

By virtue of the foregoing arrangement, wherein the carriers 12 and 14 are symmetrical about both their longitudinal and transverse medial vertical planes, end carrier 12 may be oriented with either sidewall 17 or 18 interlocked to either sidewall 21 or 22 of the center carrier 14. Further, it will be seen that the dovetail locking structure shoulders 34 and half key members 42 are located in vertically spaced relation from their associated sidewall top and bottom longitudinal edges. This structure defines upper and lower sidewall longitudinal marginal areas shown at **17*a* and 17*b*, respectively, for end carrier sidewall 17; and 22*a* and 22*b*, respectively, for center carrier sidewall 22. As a result, center carrier 14 may be initially positioned with its sidewall marginal lower areas 22*b* in flush abutment with the coplaner surfaces 48 of the shoulders 34. With the carriers 12 having their end walls 19 arrayed in substantial aligned relation with the center carrier endwalls 23 the center carrier 14 may be readily interlocked with the end carriers 12 by lowering key portions 40 into their associated slots. This movement causes half key member spline faces 47 to interlock with their associated shoulder guide faces 38**.

Upon the center carrier 14 being interlocked with the pair of end carriers 12, as described above, a tri-carrier assembly is provided. The user by grasping a slotted handle 50 of each end carrier 12, may lift and transport the assembled three carriers in the manner of a twenty-four bottle case.

Figure 3:
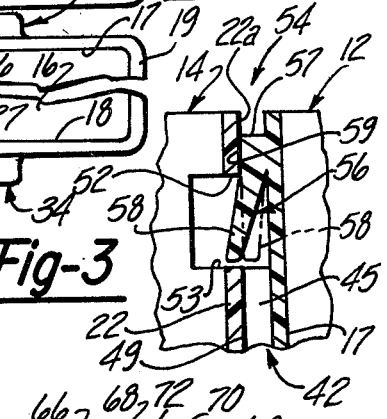
FIG. 3 is an enlarged fragmentary vertical sectional view taken on line 3—3 of FIG. 2 showing an additional positive locking means which may be used with the present invention.

FIG. 3 shows additional automatic positive catch or detent locking means 54 may be employed to prevent unwanted disengagement of the dovetail interlocking structure 30 between the end carriers 12 and the center carrier 14. In the disclosed embodiment the center carrier 14 has a rectangular aperature 52 of the catch 54 centered on the transverse medial vertical plane of divider 26 as seen in FIGS. 1 and 2. A notched opening 53 is shown in FIG. 3 formed in the central divider 26 communicating with the aperture 52. The catch locking means 54 includes a detent member 56 located on the end carrier sidewalls as shown in FIGS. 1–3. The detent 56 includes a rectangular-shaped base 57 with a resilient integral locking tab 58 projecting outwardly and downwardly at an inclined angle from the base planer upper surface 59.

The locking detent operates upon the center carrier 14 being aligned with an end carrier 12 enabling matching engagement of the dovetail guide faces 38 and spline faces 47. Carrier sidewall marginal area **22*b* is located in flush abutment with the detent face 59. This results in the resilient tab 58 being depressed into its dashed-line position shown in FIG. 3. Upon relative sliding movement of the carriers to their interlocked position the tab 58 slides within the channel 46 to its solid-line FIG. 3 position in registry with aperature 52 positively retaining the carrier 14 in locked engagement with the carrier 12. The detent tab 58 may be readily released by the user inserting a finger in the opening 52 and depressing the tab 58 while lifting the carrier 14 relative to carrier 12**.

Whether or not the locking means 54 is employed and if desired, the mating guide faces 38 and spline faces 47 can be provided with additional detent means in the form of a small convex protrusion and a complementary concave depression as indicated at **59*a*. With carriers interlocked the additional detent means 59*a*** serve to resist accidental separation by requiring a slight additional force initially to separate the carriers from each other.

Figure 4:
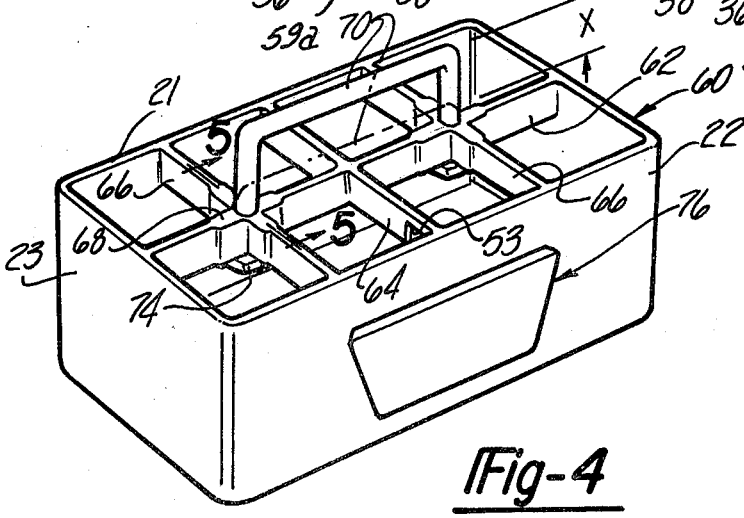
FIG. 4 is a perspective view illustrating a modified carrier unit of the present invention.
Figure 5:
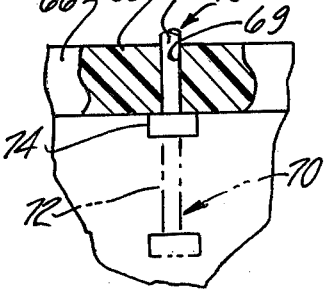
FIG. 5 is an enlarged fragmentary, vertical sectional view taken substantially on the line 5—5 of FIG. 4.

FIGS. 4 and 5 disclose an alternative retractable lifting handle. A modified box-like carrier, generally indicated at 60, substantially corresponds to the carrier 14 and like numerals are used to indicate like or corresponding parts. As seen in FIG. 4 the carrier 60 includes a longitudinal dividing bar 62 connected by a medial transverse divider bar 64 and a pair of outer divider bars 66. The outer bars 66 and the longitudinal bar 62 are thickened at their intersections to define hub portions 68 having a vertically extending bore 69 formed therein. A handle member, in the form of a inverted U-shaped circular rod 70 has a pair of downwardly extending arm portions 72 telescopically received in their associated bores 69. This arrangement allows the handle member 70 to assume a normally retracted dash-line position shown in FIG. 4. Suitable retaining means, such as stops 74, are integrally molded on the end of the handle arm portions for engagement with the underside of hubs 68. The stops 74 limit the upward movement of the handle member 70 to its extended lifting position indicated by dimension "X".

It will be noted that in one form, the carrier assembly may be employed without the use of the locking detent arrangement 54 of FIG. 3. In this mode it will be appreciated that the half-key members 42 may be formed as a single projection member without the channel 46, as shown at 76 in FIG. 4.

From the foregoing description of the invention, it is seen that there is provided a novel beverage carrier assembly 10 of light weight and sturdy construction.

Whereas, the present invention has been described with respect to specific embodiments thereof, it is to be understood that modifications and changes may be suggested to one skilled in the art.

I claim:

1. A beverage carrier assembly comprising: a pair of identical end bottle transporting carriers and a center bottle transporting carrier; each said end carrier being substantially box-shaped having bottom, side and end walls, each said side wall having an exterior surface provided with a pair of mirror image, block-like shoulder members, said shoulder members having opposed guide faces downwardly tapered at a draft angle of approximately 30 degrees from the vertical so as to define a vertically extending, downwardly converging, angular-sided slot, said guide faces being separated by a horizontal distance no less than one-half the length of said side walls; said center carrier being substantially box-shaped having bottom, side and end walls, each of said center carrier sidewalls being provided with a pair of mirror image, block-like half key members having outward-facing, angled spline faces of said half key members being aligned to interlockingly engage the guide faces of said end carrier shoulder members; said end carriers and said center carrier each including handle means; said center carrier being moveable downwardly between a pair of end carriers oriented in side-by-side predetermined spaced array to cause said spline faces of said center carrier to interlockingly engage the corresponding guide faces of said shoulder members of said end carriers to form a dovetail interlocking structure; each of said end carrier handle means being operative to be grasped by the user when said center carrier is in interlocking engagement with said end carriers whereby the end carriers and said center carrier may be lifted and transported as a unit assembly, said center carrier being separable from said end carriers by the lifting said center carrier upwardly by its handle means thereby disengaging said center carrier half key members from their associated end carrier shoulder members.

2. The combination assembly as set forth in claim 1 wherein said center carrier pair of half key members have opposed inner faces defining a vertically extending channel with their associated side wall surfaces, said center carrier side wall having a rectangular aperture, said end carrier sidewall having a detent member; said detent member having a rectangular shaped base with a resilient integral locking tab projecting outwardly and downwardly at an inclined angle from the base outer surface; downward movement of said center carrier places said half key members in their full interlock position with said shoulder members of said end carriers, causing said resilient tab portion to be flexed inwardly for sliding travel in its associated center carrier channel, wherein the resilient tab returns to its unflexed position when brought in registry with its associated center carrier side wall aperture, said arrangement positively retaining the center and end carriers in dovetail interlocked composite assembly.

3. A tri-unit beverage carrier assembly comprising a pair of identical end bottle carriers and a center bottle carrier; said end and center carriers being rectangular in shape and adapted to carry eight bottles, having bottom, side and end walls, each said end carrier sidewall having an exterior surface provided with a pair of mirror image, block-like shoulder members, said shoulder member having opposed guide faces downwardly tapered at a draft angle of approximately 30 degrees from the vertical so as to define a vertically extending, downwardly converging, angular-sided slot, said guide faces being separated by a horizontal distance greater than or equal to one-half the length of said sidewall; each said center carrier side wall provided with a singular, key member having outwardly facing spline faces, said spline faces of said key member aligned to interlockingly engage the guide faces of said end carrier shoulder members; each said end and center carriers having a retractable handle means disposed along the longitudinal axis of said carriers; said center carrier being moveable downwardly between a pair of end carriers oriented in side-by-side predetermined spaced array to cause such spline faces of said center carrier to fully engage the corresponding guide faces of said end carrier shoulder members to form a dovetail interlocking whereby said tri-unit assembly may be lifted and transported by grasping said end carrier handle means and wherein said center carrier is adapted to be separated from said end carriers by lifting said center carrier by its handle means thereby disengaging said center carrier key member from its associated end carrier shoulder member.

* * * * *

UNITED STATES PATENT AND TRADEMARK OFFICE

CERTIFICATE OF CORRECTION

PATENT NO. : 4,328,902

DATED : May 11, 1982

INVENTOR(S) : Thomas M. North

It is certified that error appears in the above—identified patent and that said Letters Patent is hereby corrected as shown below:

Column 3, line 22, "aymmetrical" should read --symmetrical--

Signed and Sealed this

*Fourteenth* Day of *September 1982*

[SEAL]

*Attest:*

GERALD J. MOSSINGHOFF

*Attesting Officer*

*Commissioner of Patents and Trademarks*